US005839883A

United States Patent [19]

Schmidt et al.

[11] Patent Number: 5,839,883

[45] Date of Patent: Nov. 24, 1998

[54] SYSTEM AND METHOD FOR CONTROLLING A MATERIALS HANDLING SYSTEM

[75] Inventors: Lawrence P. Schmidt, Lino Lakes, Minn.; Harry K. Crow, Ridgefield, Conn.

[73] Assignee: Schwing America, Inc., White Bear Lake, Minn.

[21] Appl. No.: 651,344

[22] Filed: May 22, 1996

[51] Int. Cl.[6] ..... F04B 49/00; F04B 15/02

[52] U.S. Cl. ..... 417/63; 417/900

[58] Field of Search ..... 417/206, 63, 430, 417/900, 216, 213; 137/1, 2

[56] References Cited

U.S. PATENT DOCUMENTS

| | | | |
|---|---|---|---|
| 2,698,964 | 1/1955 | Tornberg | 18/12 |
| 3,055,550 | 9/1962 | Smith et al. | 222/52 |
| 3,259,940 | 7/1966 | Kovach et al. | 18/12 |
| 3,416,676 | 12/1968 | Nolin, Jr. | 214/17 |
| 3,508,683 | 4/1970 | Van Der Schee | 222/55 |
| 4,830,219 | 5/1989 | Siemann | 222/55 |
| 4,844,296 | 7/1989 | Hayashi et al. | 222/1 |
| 4,893,992 | 1/1990 | Schlecht | 417/900 X |
| 5,106,272 | 4/1992 | Oakley et al. | 417/347 |
| 5,332,366 | 7/1994 | Anderson | 417/900 X |
| 5,336,052 | 8/1994 | Zollner et al. | 417/900 X |
| 5,356,575 | 10/1994 | Krosse et al. | 264/40.1 |
| 5,388,965 | 2/1995 | Fehn | 417/900 X |
| 5,425,906 | 6/1995 | Hashimoto | 264/40.1 |

FOREIGN PATENT DOCUMENTS

| | | | |
|---|---|---|---|
| 3109303 A1 | 3/1981 | Germany . | |
| 8102043 | 7/1981 | WIPO | 417/900 |

*Primary Examiner*—Ismael Izaguirre
*Attorney, Agent, or Firm*—Kinney & Lange

[57] ABSTRACT

A system and method is provided for controlling a materials handling system. The materials handling system preferably includes a feed system, a positive displacement pump and a disposal system. The feed system includes a material feeder, which in the preferred embodiment is a screw feeder driven by a drive, and a transition housing. The material feeder forces material through the transition housing to an inlet of the positive displacement pump. The control system includes a pressure sensor, located on the transition housing, connected to a computer. The computer is also connected to the drive of the screw feeder. During operation of the materials handling system, the pressure sensor senses a parameter indicative of material pressure within the transition housing and sends a signal to the computer representative of this parameter. The computer provides a control signal to the feed system to control operation of the materials handling system as a function of the sensed parameter.

22 Claims, 5 Drawing Sheets

SYSTEM AND METHOD FOR CONTROLLING A MATERIALS HANDLING SYSTEM

BACKGROUND OF THE INVENTION

The present invention relates to control of a system for pumping non-Newtonian materials. More particularly, it relates to a system and method for controlling a materials handling system having a feed system which delivers material to a positive displacement pump, as a function of pressure within the feed system.

Positive displacement pumps have a wide variety of applications. For example, positive displacement sludge pumps are used for conveying sludge material through pipelines in municipal and industrial applications. Positive displacement pumps offer a number of significant advantages over screw or belt conveyors. For example, a positive displacement sludge pump can pump sludge through a pipeline while containing odors in order to maintain a safe and secure working environment. Positive displacement pumps are capable of pumping thick, heavy materials which may not be practical for belt or screw conveyors.

Pump and pipeline systems also take up less space than screw or belt conveyors and, with the use of simple elbow pipes, are capable of transporting materials around corners. Additionally, positive displacement pumps offer a reduction in noise over mechanical conveyors as well as greater cleanliness and reduced spillage.

In a typical materials handling system, a feed system delivers material to a positive displacement pump which pumps the material to a disposal system. The feed system may include a belt press, an auger, a centrifuge or other devices for drying the material and delivering the material to the positive displacement pump. For example, in a sludge application, the feed system may include a centrifuge or hopper, a screw feeder and a transition housing. The centrifuge dewaters and stores the sludge prior to pumping. Once the sludge has been dewatered, the centrifuge delivers the material to the screw feeder. The screw feeder, in turn, forces the sludge material through the transition housing into an inlet of the positive displacement pump.

The positive displacement pump can assume a variety of forms, but typically includes an inlet and one or more material cylinders which pump material to an outlet. Each material cylinder includes a drive piston which is driven back and forth along a central axis of the material cylinder. During a rearward stroke, the drive piston suctions material into the material cylinder. The material is expelled from the material cylinder to the outlet by a forward stroke of the drive piston. The outlet is attached to a material disposal system.

Typically, the material disposal system includes a lengthy piping arrangement which terminates at a disposal device, such as an incinerator. Alternatively, the material disposal system could include a truck which transports the pumped material to a remote area where it is spread out over the ground, subjected to further processing, etc.

For a materials handling system to operate at a high efficiency, a variety of parameters must be optimized. For example, the positive displacement pump can only pump as much material as is provided by the feed system. Where the feed system includes a screw feeder connected to a transition housing, maximum cylinder fill efficiency theoretically occurs when the transition housing is filled with material. In this situation, the positive displacement pump is constantly supplied with enough material to fill the material cylinder(s) during a suction stroke. Setting the feed system at a maximum delivery rate would appear to be a simple method to achieve this desired constant supply of material. However, flow and compressibility characteristics of many materials often prevent the system from maintaining such a setting over a long period of time.

With specific reference to a feed system comprised of a screw feeder and transition housing, the screw feeder includes a rotatable shaft which is driven at a certain revolutions per minute (r.p.m.). The r.p.m. setting should deliver more material than can be handled by the pump, so as to optimize the material cylinder fill efficiency. However, if the r.p.m. level is too great, the material eventually packs up in the transition housing. The flow characteristics of sludge, or any other non-Newtonian material, is such that it will not shear and move backwards along the flights of the screw. Instead, as even more material is forced from the screw feeder, the pressure of the material within the transition housing becomes uncontrollably high. This high pressure in turn is imparted onto the flights and shaft of the screw feeder itself. As a result, to maintain the r.p.m. level, the shaft of the screw feeder requires an increased torque from the screw feeder drive. Often times, due to design constraints, the drive mechanism cannot meet this need, and is forced to shut down.

Several possible solutions exist for rectifying the above-stated problem. For example, the screw feeder could be run only at half capacity. Further, an oversized positive displacement pump could be used, with a resulting reduced pumping efficiency. Alternatively, the screw feeder can be provided with a high torque gear box. While these "solutions" may prevent the transition housing pressure overload problem from occurring, they are expensive and impractical. The costs associated with the purchase of a materials handling system dictates that the user achieve a high pump fill efficiency to receive an adequate return on investment. It is simply unrealistic for a materials handling system to be operated at less than its optimal capacity. Thus, maintaining at least a minimum transition housing pressure (and thus feeder speed) is equally as important as preventing transition housing pressure overload.

Therefore, a substantial need exists for a system for monitoring and controlling operation of a materials handling system, which includes a feed system delivering material to a positive displacement pump, to prevent pressure in a transition housing of the feed system from exceeding a predetermined level and/or from falling below a predetermined level, thus optimizing system performance.

SUMMARY OF THE INVENTION

The present invention provides a system and method for controlling operation of a materials handling system. In the preferred embodiment, the control system is based upon sensing a parameter related to pressure in a transition housing of a feed system. By monitoring this pressure, the material handling system can be controlled such that an optimal volume of material is delivered to a positive displacement pump, The materials handling system of the present invention includes a positive displacement pump for pumping material through a pump outlet to a disposal system. A feed system delivers material to an inlet of the positive displacement pump. In a preferred embodiment, the feed system includes a screw feeder and a transition housing.

The control system of the present invention includes a sensor and a controller. The sensor senses a parameter related to pressure in the transition housing of the feed system and delivers a signal representative of the sensed parameter to the controller. The controller generates a control signal to the feed system to control operation of the feed system as a function of the sensed parameter.

During operation of the materials handling system, a parameter is sensed by the sensor which bears a known relationship to pressure in the transition housing. The controller receives this sensed parameter and provides a control signal to the feed system as a function of the sensed parameter. In a preferred embodiment, the control signal reduces the delivery rate of the feed system. Alternatively, the control signal can increase or optimize the delivery rate.

DETAILED DESCRIPTION OF THE PREFERRED EMBODIMENTS

A. Overview of Materials Handling System 10

Figure 1:
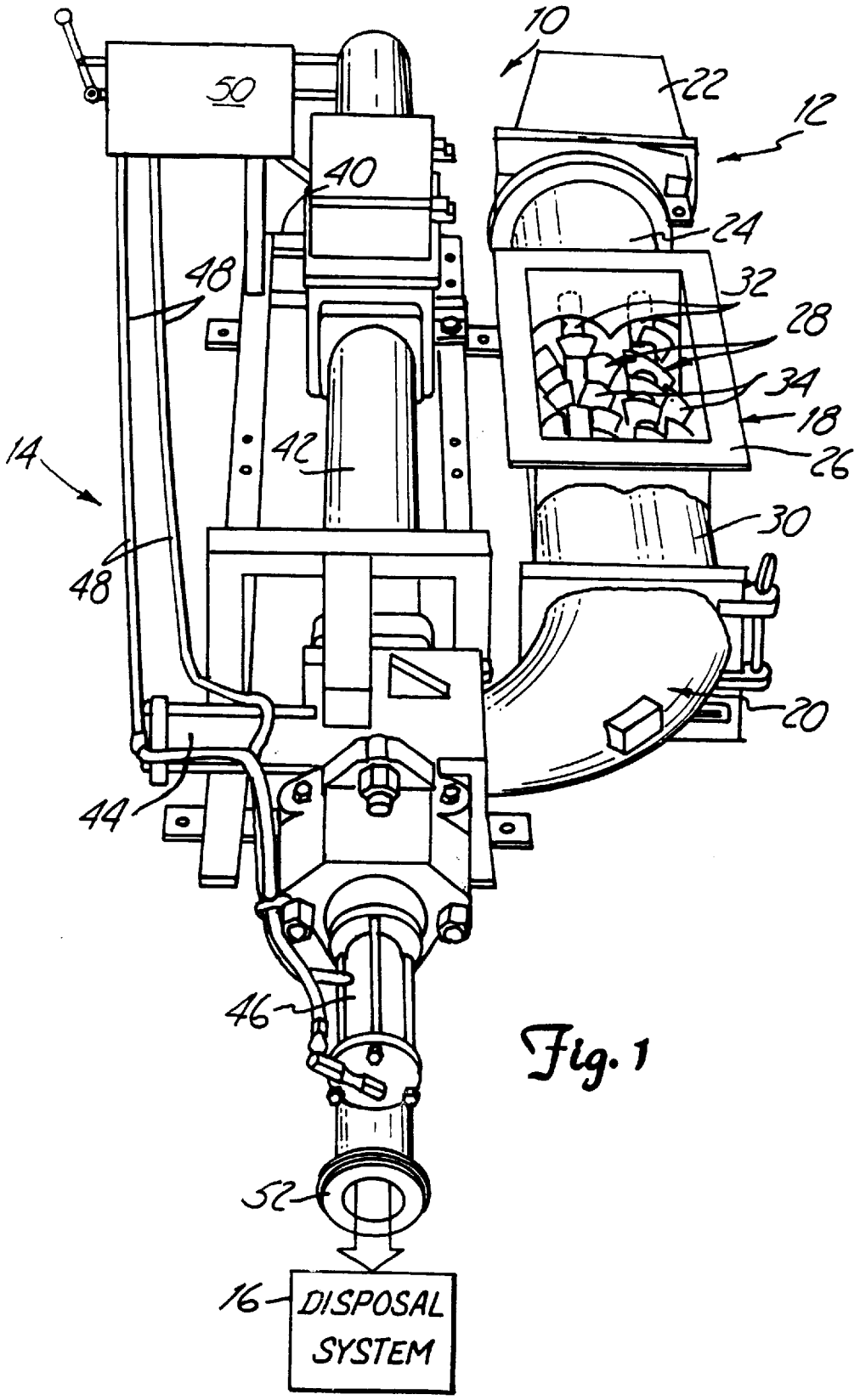
FIG. 1 is a perspective view of a materials handling system including a control system in accordance with the present invention.

FIG. 1 shows a perspective view of a materials handling system 10 incorporating a control system of the present invention. The materials handling system 10 includes a feed system 12, a positive displacement pump 14 and a disposal system 16 (shown in block form). The feed system 12 delivers material to the positive displacement pump 14. The positive displacement pump 14 pumps material to the disposal system 16.

The feed system 12 is preferably comprised of a screw feeder 18 and a transition housing 20. The screw feeder 18 includes a drive 22, an enclosure 24, an inlet hopper 26, screws 28 and an outlet housing 30. Each of the screws 28 is positioned within the inlet hopper 26 and includes a shaft 32 from which blades or flights 34 extend in a conical fashion. The drive 22 imparts a rotational torque on the shaft 32 of each of the screws 28. The rotational speed of the shaft 32 is measured in terms of r.p.m. The flights 34 of each of the screws 28 are arranged in a meshing fashion such that when the shafts 32 are rotated, the flights 34 will not interfere with one another. The flights 34 continue through the outlet housing 30 (not fully shown in FIG. 1). The outlet housing 30 is connected to the transition housing 20. While a twin screw feeder 18 is shown in FIG. 1, other approaches are equally acceptable. For example, a single auger or a conical hopper could be used.

The transition housing 20 directs material from the outlet housing 30 to the positive displacement pump 14. As shown in FIG. 1, the transition housing 20 is generally conical in shape, having a larger cross-sectional area at the point of connection to the outlet housing 30 than at the point of connection to the positive displacement pump 14. Thus, the transition housing 20 can accommodate influx of a larger amount of material from the screw feeder 18 than is required by the positive displacement pump 14 during a pumping cycle. However, the transition housing 20 can instead have a uniform diameter. Similarly, while the transition housing 20 is shown as forming a rightward bend, other configurations are equally acceptable. For example, the transition housing 20 can form an upward bend when the screw feeder 18 is positioned below the positive displacement pump 14. Basically, the transition housing 20 is designed to meet job site requirements which dictate where the screw feeder 18 is positioned with respect to the positive displacement pump 14.

The positive displacement pump 14 includes a frame 40, a material cylinder 42, a hydraulic inlet valve assembly 44, a hydraulic outlet valve assembly 46, hydraulic lines 48, a control valve assembly 50 and an outlet 52. The material cylinder 42 includes a drive piston (not shown) and is attached to the frame 40. The hydraulic inlet valve assembly 44 and the hydraulic outlet valve assembly 46 are connected to, and interact with, the material cylinder 42. Finally, the material cylinder 42, the hydraulic inlet valve assembly 44 and the hydraulic outlet valve assembly 46 are connected to the control valve assembly 50 by the hydraulic lines 48.

The transition housing 20 is connected to an inlet (not shown) of the positive displacement pump 14. Material flow through the inlet into the material cylinder 42 is controlled by the hydraulic inlet valve assembly 44. Material flow from the material cylinder 42 to the outlet 52 is controlled by the hydraulic outlet valve assembly 46. The control valve assembly 50, via the hydraulic lines 48, controls operation of the material cylinder 42, the hydraulic inlet valve assembly 44 and the hydraulic outlet valve assembly 46.

The outlet 52 is connected to the disposal system 16, which is shown simply in block form. The disposal system 16 can assume a number of different configurations. In most instances the disposal system 16 will include a conduit system which delivers material from the outlet 52 to a separate processing station. This processing station can include storage hoppers, composting, incineration, etc. The appropriate form of the disposal system 16 will vary depending upon the type of material being handled by the materials handling system 10.

Operation of the materials handling system 10 begins by receiving material (not shown) at the inlet hopper 26 of the screw feeder 18. Material is supplied to the inlet hopper 26 by a variety of devices. For example, where the material being pumped is a high solid sludge, the sludge will first be dewatered in a high speed centrifuge. The centrifuge has a gravity fed outlet which is connected to the inlet hopper 26. Alternatively, material can be supplied to the inlet hopper 26 by way of a belt conveyor, a separate screw-type feeder, or even by manual dumping.

As material is received at the inlet hopper 26, the drive 22 rotates the shafts 32 of the screws 28. Rotation of the shafts 32 forces the material along the flights 34, toward the outlet 30. Additional material is continually supplied at the inlet hopper 26.

Material forced along the flights 34 passes through the outlet 30 and into the transition housing 20. The transition housing 20 directs the material to the positive displacement pump 14. In the preferred embodiment, the hydraulic inlet valve assembly 44 includes a poppet valve (not shown). Upon actuation, the hydraulic inlet valve assembly 44 opens to allow material to flow from the transition housing 20 into the positive displacement pump 14. The material cylinder 42 contains a drive piston (not shown) which moves in a rearward fashion, drawing material from the transition housing 20 through the inlet (not shown) into the material cylinder 42. At the end of the rearward or suction stroke of the material piston, the hydraulic inlet valve assembly 44 is closed via the control valve assembly 50. The control valve assembly 50 simultaneously actuates the hydraulic outlet valve assembly 46.

As previously described, the hydraulic inlet valve assembly 44 preferably includes a poppet valve (not shown). Upon actuation, the poppet valve closes, thus stopping the flow of material from the transition housing 20 into the material cylinder 42 and preventing any backward flow during a subsequent pumping stroke. Conversely, the hydraulic outlet valve assembly 46, which also preferably contains a poppet valve (not shown), is actuated to allow material to pass from the material cylinder 42 to the outlet 52. Once the hydraulic outlet valve assembly 46 has been opened, the drive piston of the material cylinder 42 is caused to move forward, propelling the material contained within the material cylinder 42 to the outlet 52. At the end of the forward stroke of the drive piston, the control valve assembly 50 once again actuates the hydraulic inlet valve assembly 44 and the hydraulic outlet valve assembly 46. The above-described process of actuating the material cylinder 42, the hydraulic inlet valve assembly 44 and the hydraulic outlet valve assembly 46 is repeated. Material from the outlet 52 is pumped to the disposal system 16.

The positive displacement pump 14 has been preferably described as being a single cylinder pump. However, other pumps with variations in the configuration of the hydraulic and control valve mechanisms can be used as well. Further, a two-cylinder or multi-cylinder positive displacement pump can be used. For example, the positive displacement pump 14 can be of the type which uses a pivoting transfer tube valve, instead of poppet valves, to connect the material cylinder 42 to the outlet 52 during the entire pumping stroke.

B. Control System

In addition to the standard feed system 12, the positive displacement pump 14 and the disposal system 16, the materials handling system 10 of the present invention includes a control system, a component of which is shown in FIG. 1. The control system includes a pressure sensor 60 located within the transition housing 20. While a portion of the pressure sensor 60 is shown in FIG. 1 as extending outwardly from the transition housing 20, this need not be the case.

In the preferred embodiment, the pressure sensor 60 is a pressure transducer, capable of sensing the pressure of material within the transition housing 20 and producing an electrical signal representative of the sensed pressure. Alternatively, the pressure sensor 60 can take a variety of forms, such as a pressure gauge, etc, or any other device or approach for measuring pressure or a parameter which bears a known relationship to pressure of material within the transition housing 20. For example, where the compressibility of the material being pumped and the volume of the transition housing 20 is known, flow measurements could be made at both an inlet and an outlet of the transition housing 20 to calculate material pressure.

Figure 2:
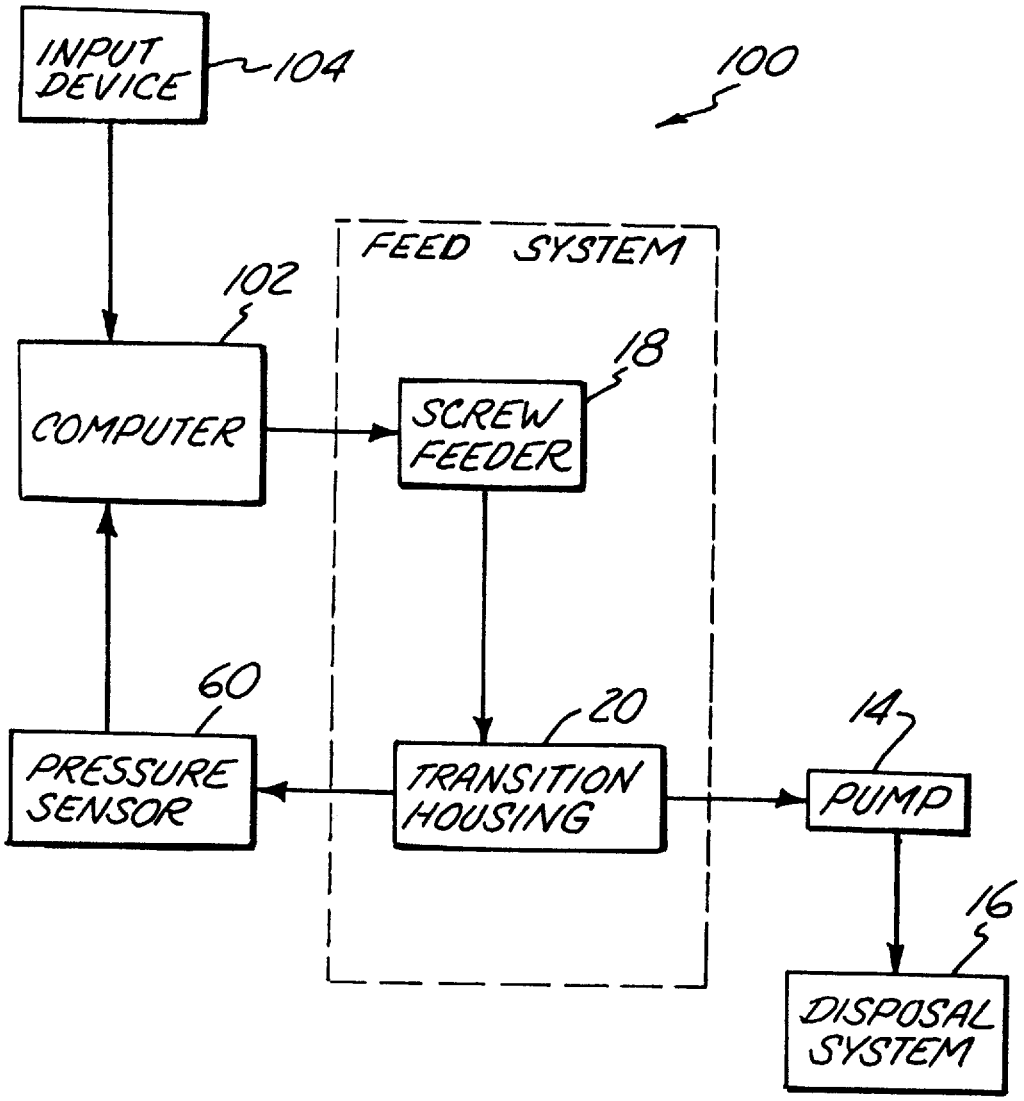
FIG. 2 is a block diagram of a control system for a materials handling system in accordance with the present invention.

FIG. 2 shows one possible embodiment of a control system 100 which monitors and controls the operation of the materials handling system 10 (shown in FIG. 1). The control system 100 includes the feed system 12 (shown with broken lines), the positive displacement pump 14, the pressure sensor 60, a computer 102 and an input device 104. The feed system 12 is preferably comprised of the screw feeder 18 and the transition housing 20. The screw feeder 18, the pressure sensor 60 and the input device 104 are all connected to the computer 102. The screw feeder 18 is connected to the transition housing 20 which feeds into the positive displacement pump 14. Finally, the positive displacement pump 14 is connected to the disposal system 16.

In preferred embodiments, the computer 102 is a microprocessor-based computer including associated memory and associated input/output circuitry. However, in other embodiments, the computer 102 can be replaced with a programmable logic controller (PLC) or other controller or equivalent circuitry.

The input device 104 can also take a variety of forms. In one preferred embodiment, the input device 104 is a keypad entry device. The input device 104 can also be a keyboard, a remote program device or any other suitable mechanism for providing information to the computer 102.

As previously described, the pressure sensor 60 senses a parameter indicative of material pressure within the transition housing 20. The pressure sensor 60 supplies the computer 102 with a signal representative of this sensed parameter. The computer 102 is connected to the screw feeder 18 so as to control the material delivery rate to the transition housing 20. Thus, where the screw feeder 18 is powered by the drive 22 (shown in FIG. 1), the computer 102 can control the delivery rate by controlling the drive 22. Where alternative drive systems are employed, the computer 102 is connected to and controls that particular drive assembly.

The input device 104 is used to provide information to the computer 102 regarding allowable material pressure within the transition housing 20. In the preferred embodiment, the input device 104 will provide a maximum allowable material pressure. As will be discussed elsewhere, minimum material pressure and/or optimal material pressure can also be supplied.

With respect to the preferred embodiment, the maximum allowable material pressure within the transition housing 20 is the pressure above which overload or breakdown of the screw feeder 18 occurs. For example, when sludge material is delivered from the feed system 12 to the positive displacement pump 14 at a rate greater than the pumping rate, sludge will accumulate in the transition housing 20. As more sludge is supplied to the transition housing 20, it creates an increased sludge pressure within the transition housing 20. Because sludge is non-Newtonian, it will not shear over the flights 34 (shown in FIG. 1), and instead continues to accumulate within the transition housing 20 and increases in pressure. The build up of material and therefore pressure is applied directly to the screws 28 (shown in FIG. 1). As a result, the drive 22 (shown in FIG. 1) must produce a larger torque to maintain the r.p.m. setting. If left unchecked, the increase in pressure will reach a point where the screw feeder 18 can no longer operate, causing an overload and possible shutdown or damage to the screw feeder 18. It is possible through trial and error to ascertain this maximum allowable material pressure within the transition housing 20. Alternatively, the maximum allowable material pressure can be determined from manufacturer specifications for the screw feeder 18. This data is entered into the computer 102 via the input device 104. Even further, the maximum allowable material pressure value can be preprogrammed into the computer 102, thus eliminating the need for the input device 104.

With an appropriate maximum allowable material pressure value stored in the computer 102, the control system 100 functions to facilitate optimal system operation while avoiding overload of the feed system 12.

Material enters the feed system 12 at the screw feeder 18. The screw feeder 18 delivers material through the transition housing 20 to the positive displacement pump 14. The positive displacement pump 14, in turn, pumps material to the disposal system 16. As the screw feeder 18 forces material through the transition housing 20, the pressure sensor 60 constantly senses a parameter indicative of material pressure within the transition housing 20. In the preferred embodiment, the pressure sensor 60 is a pressure transducer which directly senses material pressure. Alternatively, some other parameter which bears a known relationship to material pressure in the transition housing 20 can be used.

The pressure sensor 60 provides signals to the computer 102 representative of the sensed parameter. The computer 102 compares the sensed parameter with the maximum allowable material pressure. Where the sensed parameter is something other than actual pressure, the computer 102 will convert the sensed parameter into a pressure value for purposes of comparison with the predetermined maximum allowable pressure value. Alternatively, a predetermined value corresponding with the sensed parameter can be stored by the computer 102 for comparison. For example, where the pressure sensor 60 senses an electrical parameter, such as current, as a function of material pressure, that parameter will be compared to a corresponding maximum value. When the computer 102 determines that the sensed pressure is approaching the maximum allowable pressure, thus indicating that the feed system 12 is approaching an overload or breakdown situation, the computer 102 generates a control signal to reduce the speed of the screw feeder 18. The speed can be reduced by a predetermined r.p.m. amount, by a percentage of the current setting, or any other appropriate method.

The control system 100 also provides an independent method for controlling and optimizing fill efficiency of the positive displacement pump 14 when the output value of the pump 14 itself is changed. For example, if the pump 14 were pumping at 8 gallons per minute, and the operator needed to increase this delivery to 20 gallons per minute, the pump 14 and thus the screw feeder 18 must ramp up. However, the requisite increase in screw feeder 18 delivery rate and pump 14 delivery rate is not linear. By using the control system 100 of the present invention, the increase in delivery of material to the transition housing 20 by the screw feeder 18 would not increase above a set pressure.

While the control system 100 has been described as preferably utilizing a single maximum allowable material pressure value, a family of values could be used. For example, the maximum allowable material pressure in the transition housing 20 could be assigned different values, depending upon the flow rate of material from the screw feeder 18. In other words, the maximum allowable material pressure could be a first value at a first flow rate and a second value at a second flow rate. The various maximum allowable material pressure values are stored by the computer 102, possibly in the form of a lookup table. During operation, a flow sensor senses a flow rate out of the screw feeder 18. The computer 102 references the previously entered lookup table to determine a maximum allowable pressure at that particular flow rate. Based upon a comparison with material pressure, as sensed by the pressure sensor 60, the computer 102 generates a control signal.

The control system 100 of the present invention has been described as preferably comparing a sensed parameter indicative of material pressure within the transition housing 20 to a maximum allowable material pressure. Other forms of comparison and control are equally acceptable. For example, the sensed parameter could be compared to a minimum pressure. Thus, whenever pressure within the transition housing 20 becomes too low, the computer 102 will increase the delivery rate of the screw feeder 18.

Similarly, an optimal pressure value or range can be used. Whenever the pressure sensor 60 indicates that the sensed pressure is above or below this value, the computer 102 adjusts the screw feeder 18 accordingly. Alternatively, the "on-off" control approach can instead be a proportional control. Based upon a predetermined mathematical formula, an optimal transition housing material pressure value can be determined. This mathematical formula will likely include variables related to screw feeder output, pump output, transition housing and compressibility characteristics of the material being pumped. During operation, the computer 102 will utilize sensed values which in turn are plugged into the mathematical formula. Alternatively, a lookup table or fuzzy logic can be used. Based upon the mathematical formula, the computer 102 will determine the optimal transition housing pressure. When the sensed material pressure is something other than the optimal value, the screw feeder 18 will be controlled by the computer 102 so that the optimal pressure value is obtained.

C. Alternative Control System 150

Figure 3:
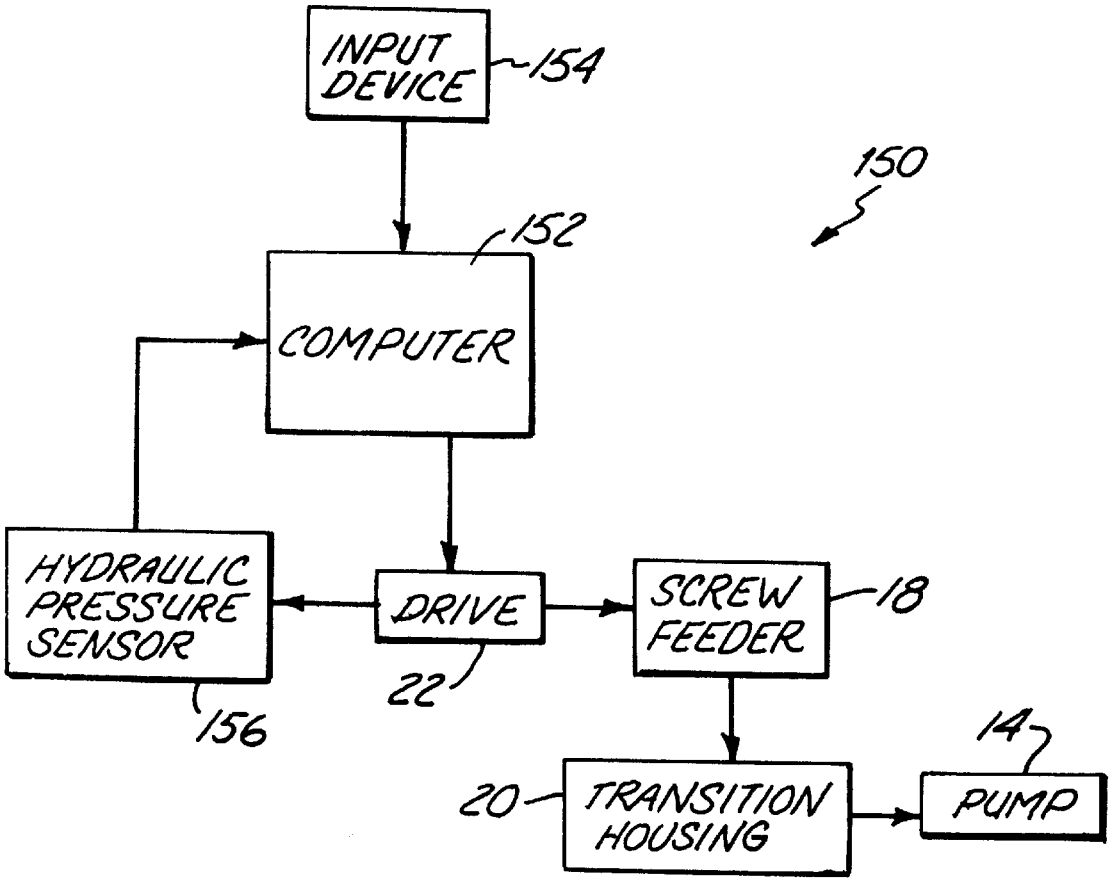
FIG. 3 is a block diagram of an alternative embodiment of a control system in accordance with the present invention.

An alternative embodiment of a control system 150 is shown in FIG. 3. The control system 150 includes the screw feeder 18, which is driven by the hydraulic drive 22, the transition housing 20, the positive displacement pump 14, a computer 152, an input device 154 and hydraulic pressure sensor 156. The computer 152 is connected to the hydraulic drive 22, the input device 154 and the hydraulic pressure sensor 156. The hydraulic pressure sensor 156, in addition to being connected to the computer 152, is connected to the hydraulic drive 22. As with previous embodiments, the screw feeder 18 forces material into the transition housing 20 which, in turn, directs the material to the positive displacement pump 14.

In a preferred embodiment, the computer 152 is a microprocessor-based computer including associated memory and associated input/output circuitry. However, in other embodiments, the computer 152 can be replaced with a programmable logic controller (PLC) or other controller or equivalent circuitry.

The input device 154 can also take a variety of forms. In one preferred embodiment, the input device 154 is keypad entry device. The input device 154 can also be a keyboard, a remote program device or any other suitable mechanism for providing information to the computer 152.

The hydraulic pressure sensor 156 is a sensor used to measure the hydraulic pressure of the hydraulic drive 22 which powers the screw feeder 18. Where the screw feeder 18 is regulated by a system utilizing an approach other than hydraulics, the hydraulic pressure sensor 156 will be replaced by an appropriate sensor.

The hydraulic pressure sensor 156 provides an indication of the operational status of the screw feeder 18. From this information, the computer 152 determines whether the screw feeder 18 is approaching an overload situation. In other words, the hydraulic pressure of the hydraulic drive 22 driving the screw feeder 18 will increase as material packs up and pressure builds within the transition housing 20. Thus, the hydraulic pressure of the hydraulic drive 22, similar to pressure within the transition housing 20, provides an indication of the required torque for the screw feeder 18 to maintain a certain r.p.m. As pressure within the transition housing 20 builds, the torque requirement also increases.

When the hydraulic pressure within the hydraulic drive 22, as sensed by the hydraulic pressure sensor 156, reaches a predetermined level, rotational speed of the screw feeder 18 must be reduced to prevent an overload. The computer 152 compares the sensed pressure with a predetermined pressure value previously entered via the input device 154. When the sensed pressure exceeds the predetermined value, the computer 152 generates a control signal to the hydraulic drive 22 to reduce the rotational speed of the screw feeder 18. This reduction can, for example, be by a preset range or a percentage of the current setting. Alternatively, the computer 152 will reduce the speed of the screw feeder 18 when the sensed hydraulic pressure falls within a certain percentage of the predetermined value.

Preferably, the predetermined value is determined by trial and error. More particularly, a transition pressure sensor (60 in FIG. 2) is connected to the transition housing 20 and the computer 152. As previously described with reference to FIG. 2, the transition pressure sensor 60 senses material pressure within the transition housing 20. Through trial and error, a correlation can be established between pressure in the transition housing 20 and hydraulic pressure of the hydraulic drive 22. Based upon this correlation, the maximum allowable hydraulic pressure value is determined, above which an overload or shut down will occur. Similarly, a minimum hydraulic pressure or an optimal hydraulic pressure can be determined and utilized.

Alternatively, the input device 154 can be omitted, and replaced simply by a transition pressure sensor (not shown) which functions as described above. Over time, the computer 152 will collect information from the hydraulic pressure sensor 156 and the transition pressure sensor to develop a correlation between pressure within the hydraulic drive 22 and pressure within the transition housing 20. With this correlation established, the computer 152 would then calculate a maximum allowable hydraulic pressure to be used as a comparison bench mark for controlling operation of the screw feeder 18.

The system 150 can be modified slightly to account for different feeder drives. For example, where a separate electric motor is used to drive the screw feeder 18, the hydraulic pressure sensor 156 can be replaced by an ampere meter which senses the ampere draw of the electric motor. The overload condition would be reached where the electric motor reaches a maximum allowable ampere draw. Additionally, the electric motor can include a variable frequency drive (VFD) control. With this configuration, the computer 152 would control the VFD, as opposed to the hydraulic drive 22, to increase and/or decrease the speed of the screw feeder 18.

D. Other Applications

Figure 4:
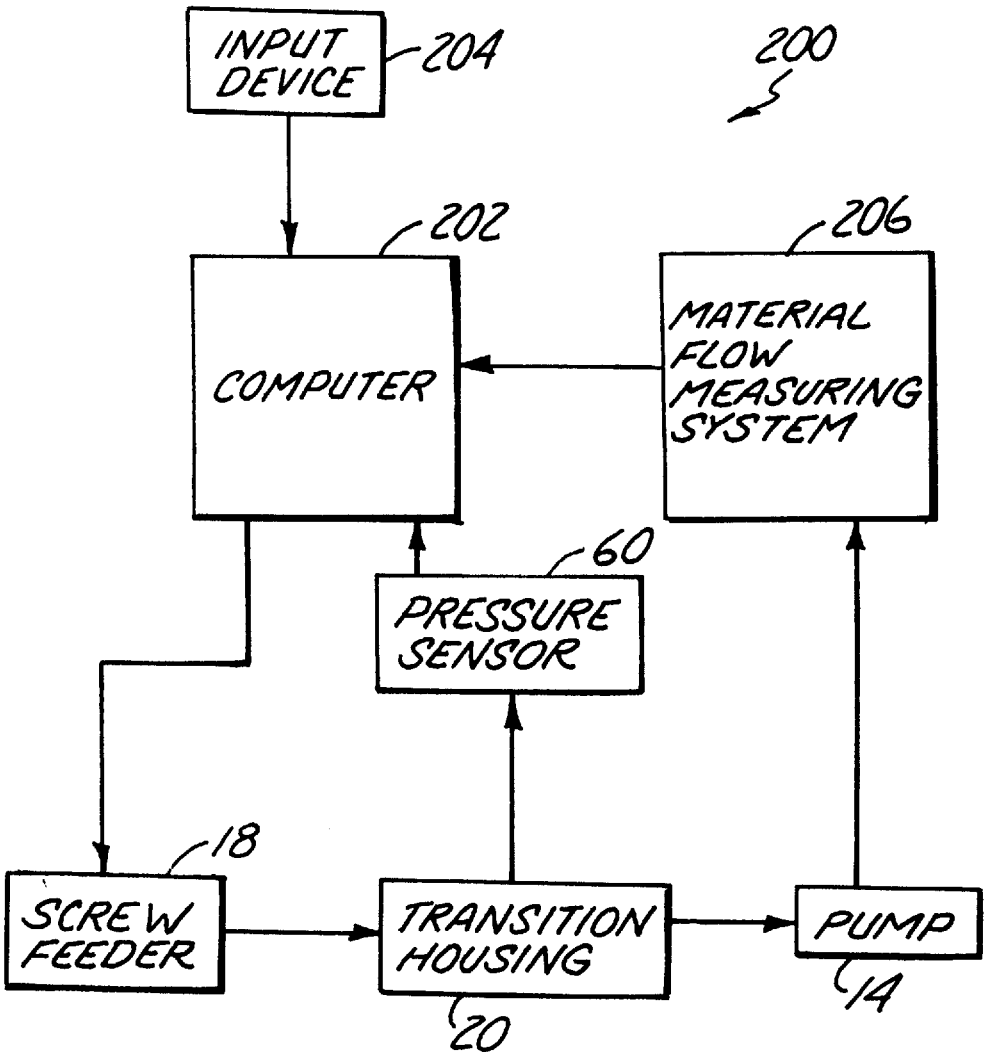
FIG. 4 is a block diagram of another alternative embodiment of a control system in accordance with the present invention.

The monitoring and control system of the present invention can be used in conjunction with other monitoring systems to control operations of a materials handling system. One embodiment of such a control system 200 is shown in FIG. 4. The control system 200 includes the positive displacement pump 14, the screw feeder 18, the transition housing 20, the pressure sensor 60, a computer 202, an input device 204 and a material flow measuring system 206. The pressure sensor 60 is connected to the transition housing 20 for sensing a parameter indicative of pressure within the transition housing 20 and supplying a representative signal to the computer 202. The input device 204 is connected to the computer 202. Finally, the material flow measuring system 206 is connected to the positive displacement pump 14 and the computer 202.

The computer 202 is, in a preferred embodiment, a microprocessor-based computer included associated memory and associated input/output circuitry. However, in other embodiments, the computer 202 can be replaced with a programmable logic controller (PLC) or other controller or equivalent circuitry.

The input device 204 can also take a variety of forms. In one preferred embodiment, the input device 204 is a keypad entry device. The input device 204 can also be a keyboard, a remote program device or any other suitable mechanism for providing information to the computer 202.

The material flow measuring system 206 senses a certain parameter or parameters related to operation of the positive displacement pump 14. More particularly, these parameters bear a known relationship to a fill efficiency of the positive displacement pump 14. For example, where the positive displacement pump 14 incorporates poppet valves to control the intake and exit of material from the positive displacement pump 14, a plurality of sensors can be used to provide an indication of the percent fill of the material cylinder 42 (shown in FIG. 1) during each pumping stroke of the positive displacement pump 14. This information allows the computer 202 to calculate the fill efficiency for the positive displacement pump 14. Alternatively, the material flow measuring system 206 can include a magnetic flow meter which senses a material flow rate from the pump 14 along with a stroke counter which monitors the number of piston strokes. In combination, these devices provide enough information to determine material volume per pumping cycle. Detailed discussions of the material flow measuring system 206 which could be used with the present invention may be found in Oakley et al., U.S. Pat. No. 5,106,272, which is incorporated herein by reference.

During operation, the screw feeder 18 provides material through the transition housing 20 to the positive displacement pump 14. The positive displacement pump 14 then pumps the material to an outside source. The material flow measuring system 206 senses various operating parameters of the positive displacement pump 14 which are then supplied to the computer 202. From this information, the computer 202 calculates the fill efficiency of the positive displacement pump 14. The computer 202 compares the calculated fill efficiency with a predetermined value, previously entered into the computer 202 via the input device 204. When the calculated fill efficiency of the positive displacement pump 14 falls below the predetermined level, it is an indication that the positive displacement pump 14 is not receiving enough material from the screw feeder 18.

Before sending a control signal to the screw feeder 18 to increase material delivery rate, the computer 202 determines the pressure within the transition housing 20 via information received from the pressure sensor 60. The computer 202 compares the sensed pressure of the transition housing 20 with a predetermined value. So long as the sensed pressure of material within the transition housing 20 falls below this predetermined value, the computer 202 will signal the screw feeder 18 to increase material supply to the positive displacement pump 14. If, however, the sensed pressure is at or above the predetermined value, the computer 202 will not cause the screw feeder 18 to increase material flow, as to do so would otherwise create an overload situation. Instead, an output device (not shown) can be provided by which the computer 202 will signal an operator that a system problem is occurring.

The control system 200 can also be used to optimize the speed of the screw feeder 18 based upon a comparison of fill efficiency and transition housing pressure. Some materials have characteristics which allows a certain amount of shearing along the flights 34 (FIG. 1) of the screw feeder 18. When this occurs, it is possible that an increase in the speed of the screw feeder 18 will not result in an increased transition housing pressure or cylinder fill efficiency. For example, the pump 14, pumping a certain sludge material, may have an 80% fill efficiency (calculated by the computer 202 based upon signal(s) from the material flow measuring system 206) with a screw feeder speed of 30 r.p.m. and a transition housing pressure of 15 p.s.i. (calculated by the computer 202 based upon signal(s) from the pressure sensor 60). That same pump 14, pumping the same material, may have the same 80% fill efficiency and 15 p.s.i. transition housing pressure at a screw feeder rate of 40 r.p.m. Under these conditions, the system 200 would limit the speed of the screw feeder 18 to the 30 r.p.m. rate because the increase in speed did not effectuate an increase in fill efficiency or change the transition housing pressure. Thus, the speed of the screw feeder 18 is optimized.

Figure 5:
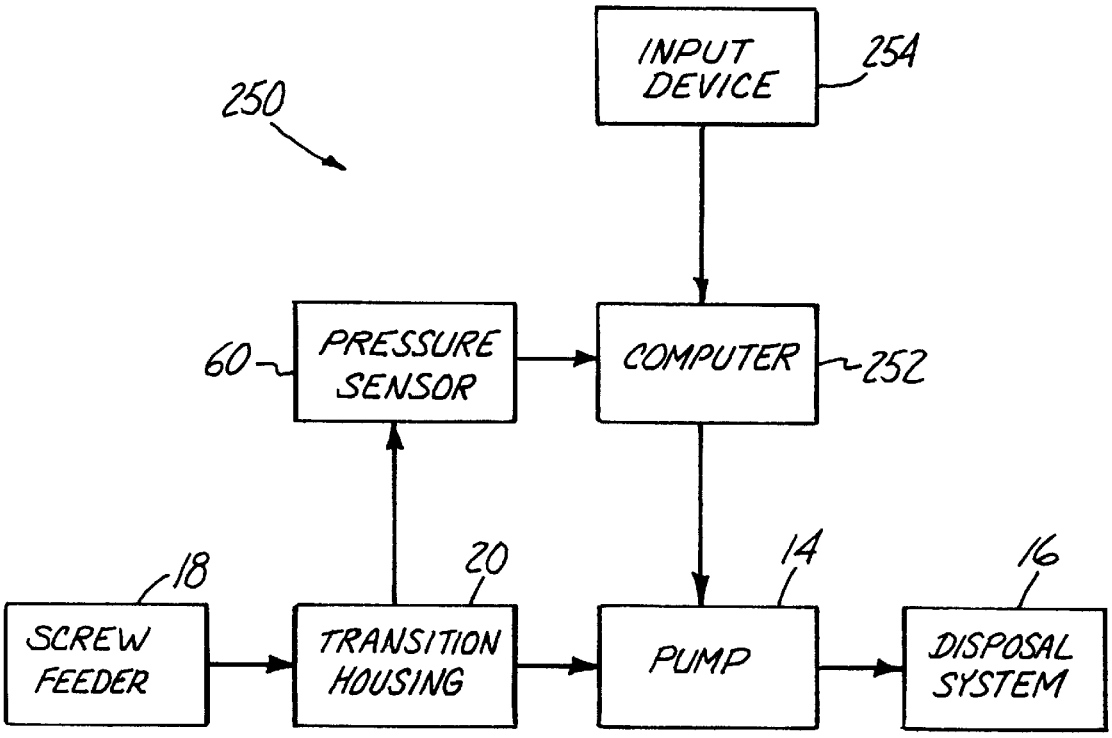
FIG. 5 is a block diagram of another alternative embodiment of a control system in accordance with the present invention.

The present invention can also be used to control operations of the positive displacement pump 14, as shown in FIG. 5. FIG. 5 depicts a control system 250 comprised of the screw feeder 18, the transition housing 20, the positive displacement pump 14, the disposal system 16, the pressure sensor 60, a computer 252 and an input 254. The pressure sensor 60 is connected to the transition housing 20 for sensing a parameter indicative of pressure within the transition housing 20 and supplying a representative signal to the computer 252. The input device 254 is connected to the computer 252. Finally, the computer 252 is connected to the pump 14.

As with previous embodiments, the screw feeder 18 provides material through the transition housing 20 to the pump 14 which pumps the material to the disposal system 16. During operation, the computer 252 receives information from the pressure sensor 60 relating to pressure within the transition housing 20. When the sensed pressure (or a parameter indicative of pressure) falls below a predetermined value previously entered into the computer 252 via the input 254, it is an indication that little or no material is being delivered to the pump 14. In this situation, the computer 252 causes the pump 14 to shutdown. To accomplish this shutdown, the computer 252 can be connected to a pump control panel (not shown), effectively bypassing the hydraulic control valve assembly 50 (shown in FIG. 1) and deactivating the pump 14.

Alternatively, the embodiment presented in FIG. 5 can be used during start up of the pump 14. Initially, material is supplied to the screw feeder 18, which then begins to propel the material through the transition housing 20 to the pump 14. Until a sufficient amount of material has accumulated in the transition housing 20, the pump 14 need not be activated. Thus, the computer 252 monitors material pressure in the transition housing 20 via the pressure sensor 60. Once the sensed pressure is above a predetermined value, the computer 252 signals the pump 14 to start pumping.

E. Conclusion

The present invention provides a new monitoring and control system and method for controlling a materials handling system operations. The control system and method senses a parameter indicative of material pressure within the transition housing portion of the feed system or the positive displacement pump. The sensed parameter is compared to a predetermined value. Based upon the comparison, a control signal is generated to control the delivery rate of the feed system or the positive displacement pump. The sensed parameter can be compared to a maximum value, a minimum value and/or an optimal value or range. The feed system can be caused to increase or decrease the material delivery rate. The control system of the present invention is inexpensive and can easily be incorporated into an existing materials handling system. Finally, the control system of the present invention can be used with other systems to improve pumping efficiency.

Although the present invention has been described with reference to preferred embodiments, workers skilled in the art will recognize that changes may be made in form and detail without departing from the spirit and scope of the invention. For example, the control system of the present invention has been described as preferably controlling a materials handling system which handles dewatered sludge. However, systems handling numerous other types of materials are equally applicable, such as chemical waste, food processing by-products, forage products, etc. Basically, any materials handling system which handles a non-Newtonian material can be monitored and controlled by the present invention.

In a preferred embodiment, the control system of the present invention utilizes a pressure transducer attached to the transition housing of the feed system. Other types of sensors and/or locations are equally applicable. For example, one described alternative embodiment utilizes a hydraulic pressure sensor located on the screw feeder drive. Other alternative embodiments exist and can be used so long as they sense a parameter which is indicative of material pressure in the transition housing.

While the preferred embodiment includes a screw feeder, the control system of the present invention is in no way limited to such a device. For example, a high speed centrifuge can be used to deliver material directly to the pump inlet. In such a case, the above-described transition housing is the point of interface between the pump inlet and the centrifuge. A parameter indicative of material pressure at the interface area is sensed and supplied to a computer. Based upon known operating constraints of the centrifuge, a predetermined maximum pressure value is utilized by the computer as a comparison point with the sensed pressure. Whenever the sensed pressure exceeds the maximum allowable pressure, the feed rate of material from the centrifuge to the pump inlet is reduced by a control signal from the computer.

What is claimed is:

1. A method for controlling operation of a materials handling system having a feed system which delivers material to a positive displacement pump, the positive displacement pump having an inlet for receiving material delivered by the feed system and an outlet through which material is pumped, the feed system including a feeder which forces material through a transition housing to the inlet of the positive displacement pump, the method including:

sensing pressure in the transition housing; and providing a control signal to the feed system to control operation of the feed system as a function of the sensed pressure.

2. The method of claim 1 wherein the feeder is a screw feeder having a rotatable shaft and extending flights, wherein rotational speed of the rotatable shaft is controlled in response to the control signal.

3. The method of claim 1, further including:

comparing the sensed parameter to a predetermined value, wherein the control signal is a function of the comparison.

4. The method of claim 3 wherein the predetermined value bears a known relationship to a maximum allowable material pressure within the transition housing.

5. The method of claim 3 wherein the predetermined value bears a known relationship to an optimal material pressure within the transition housing.

6. The method of claim 3 wherein the predetermined value bears a known relationship to a minimum allowable pressure within the transition housing.

7. The method of claim 3, further including:

storing information related to a predetermined value.

8. The method of claim 1 wherein the feeder is powered by a hydraulic drive, and further wherein the parameter is hydraulic pressure within the hydraulic drive.

9. A method of controlling operation of a materials handling system having a feed system which delivers material to a positive displacement pump, the positive displacement pump having an inlet for receiving material delivered by the feed system and an outlet through which material is pumped, the feed system including a feeder which forces material through a transition housing to the inlet of the positive displacement pump, the method including:

determining a fill efficiency of the positive displacement pump based upon operation of the positive displacement pump;

sensing pressure in the transition housing; and controlling operation of the feed system based upon the fill efficiency and the pressure in the transition housing.

10. The method of claim 9 wherein controlling operation of the feed system includes:

creating an output signal when the fill efficiency falls below a predetermined efficiency value;

comparing the second parameter to a predetermined pressure value in response to the output signal; and providing a control signal as a function of the comparison of the second parameter to the predetermined pressure value.

11. The method of claim 10 wherein the predetermined pressure value bears a known relationship to a maximum allowable material pressure within the transition housing.

12. The method of claim 9 wherein the feeder is a screw feeder having a rotatable shaft, and wherein controlling operation of the feed system includes controlling a rotational speed of the rotatable shaft.

13. A control system for controlling operation of a materials handling system having a feed system which delivers material to a positive displacement pump, the positive displacement having an inlet for receiving material delivered by the feed system and an outlet through which material is pumped, the feed system including a feeder which forces material through a transition housing to the inlet of the positive displacement pump, the system comprising:

means for sensing pressure within the transition housing; and means for generating a control signal to the feed system to control operation of the feed system as a function of the sensed pressure.

14. The control system of claim 13 further comprising:

means for comparing the sensed parameter to a predetermined value, wherein the control signal is a function of the comparison.

15. The control system of claim 13 wherein the rate at which the feed system delivers material to the positive displacement pump is controlled as a function of the control signal.

16. The control system of claim 13 wherein the means for sensing is a pressure transducer.

17. The control system of claim 16 wherein the pressure transducer is positioned within the transition housing.

18. The control system of claim 13, further comprising:

means for entering information related to a maximum material pressure within the transition housing.

19. A method of controlling operation of a materials handling system having a feed system which delivers material to a positive displacement pump, the positive displacement pump having an inlet for receiving material delivered by the feed system and an outlet through which material is pumped, the feed system including a feeder which forces material through a transition housing to the inlet of the positive displacement pump, the method comprising:

sensing a parameter related to pressure in the transition housing; and providing a control signal to the positive displacement pump to control operation of the positive displacement pump as a function of the sensed parameter.

20. The method of claim 19, further including:

comparing the sensed parameter to a predetermined value, wherein the control signal is a function of the comparison.

21. The method of claim 20 wherein the predetermined value bears a known relationship to a minimum allowable material pressure within the transition housing, and further wherein the control signal deactivates the positive displacement pump.

22. The method of claim 20 wherein the predetermined value bears a known relationship to a minimum allowable material pressure within the transition housing, and further wherein the control signal activates the positive displacement pump.

* * * * *